United States Patent [19]

Hwang

[11] Patent Number: 4,561,138

[45] Date of Patent: Dec. 31, 1985

[54] FOLDABLE BABY BED

[76] Inventor: Tsong-Ching Hwang, No. 54-5, Hsin-Sheng S. Rd. Sec. 1, Taipei, Taiwan

[21] Appl. No.: 566,224

[22] Filed: Dec. 28, 1983

[51] Int. Cl.[4] ..... A47D 9/00

[52] U.S. Cl. ..... 5/102; 5/99 R; 5/106

[58] Field of Search ..... 5/93 R, 99 R, 99 A, 5/99 C, 101, 102, 103, 105, 106

[56] References Cited

U.S. PATENT DOCUMENTS

| | | | |
|---|---|---|---|
| 1,102,140 | 6/1914 | Collins | 5/101 |
| 1,604,703 | 10/1926 | Lynch | 5/99 C |
| 2,132,988 | 10/1938 | Leibo | 5/99 C |
| 2,536,357 | 1/1951 | David | 5/99 R |
| 2,739,320 | 3/1956 | Kostka | 5/93 R |

*Primary Examiner*—Kenneth J. Dorner
*Assistant Examiner*—Michael F. Trettel
*Attorney, Agent, or Firm*—Cushman, Darby & Cushman

[57] ABSTRACT

An improved foldable baby bed comprising a foldable bed frame and a foldable bed base by such a structure the bed frame can be swingably suspended on two support rods. The bed frame has a hinged connection at each end and middle of the left and right side tube of its upper and lower boundary tubes respectively, and the end of the left and right side tubes of the boundary tube for the base respectively for horizontal folding. The boundary tube of the base has a folding mechanism at each side respectively and the said folding mechanism is composed of a male and a female joint elements which are hinged together and connectable with each other. The female joint element has a -like cross sectional end for inserting of the -like cross sectional end of the male joint element and the -like cross sectional opening of the male joint element has two lips extending laterally.

3 Claims, 7 Drawing Figures

FOLDABLE BABY BED

FIELD OF THE INVENTION

The present invention relates to collapsible containers and particularly to an improved foldable baby bed, and more particularly to a foldable bed with an improved folding mechanism, bed frame fastener mechanism and bed cushion fastener mechanism.

BACKGROUND OF THE INVENTION

Generally, the body and frame of a baby bed are made of tubular material such as round steel pipes or square pipes. It is, however, rather difficult to account for all relevant criteria in making the body and frame of a folding bed. Indeed, the load capacity or strength of the bed must be considered and the possibility of unintentional folding during use must be guarded against. Such considerations are essential in designing folding mechanisms. Meanwhile only conventional small baby carriages fulfill such essentials; baby beds which are for sleeping and playing therein have not met such essential requirements. In this regard it must be recognized that a small baby carriage does not require extensive or multiple folding operations because it is small in size. Consequently, the volume under consideration before or after folding is not very much. Contrariwise, a large baby bed always has to be folded in order to reduce space for its storage.

SUMMARY OF THE INVENTION

The present invention provides an improved foldable baby bed having a particular folding mechanism. The mechanism includes a pair of male and female joint elements which are hinged together and connectable with each other. The female joint element has a generally U-shaped cross section for engaging the generally U-shaped cross section of the male joint element. The generally U-shaped cross section of the male joint element has two lateral tab extensions. By pressing the tab extensions, the gap across the generally U-shaped cross section can be decreased to thereby permit the release and disengagement of the female joint elements. This permits easy folding. Indeed, after releasing pressure on the tab extensions, the bed can be extended.

The invention also comprises a bed frame fastener mechanism. The fastener mechanism includes a first member and a second member which can fasten each other. The second member is made of a plate including two L-shaped openings arranged in opposite position and the first member is made of an U-shaped plate having round outward extensions configured to be received by and fastened to the L-shaped openings of the second member.

The invention also provides a bed frame which can swing about two support rods. The support rods extend from the front and back part of a boundary tube of the bed base. The invention further provides an improved cushion fastener mechanism installed at the front edges of the cushion. The cushion fastener mechanism includes a transverse tube, fastening rods and a spring.

The present invention provides a foldable baby or infant enclosure overcoming disadvantages with the previously described conventional apparatuses.

DETAILED DESCRIPTION OF THE PRESENT INVENTION

The improved foldable baby bed of the present invention includes foldable bed frame and foldable bed base. The bed frame is composed of an upper and a lower boundary tube, a plurality of support posts between the upper and lower boundary tubes. The bed frame is suspended and swingable with two support posts functioning as pivots. A hinged connection is at the middle and also at the end of each of the left and right side tubes of the bed frame. The hinged connection permits horizontal folding. The bed base is composed of a boundary tube with four castors at its four lower corners, the two aforesaid support posts at the middle of its front and back sides extending upwardly respectively. The present invention includes a folding mechanism at the end of and at the middle of each of the left and right boundary tubes of the base. The structure is further characterized by the design of a pair of male and female joint elements which are hinged together and connectable with each other, wherein the female joint element has a generally U-shaped cross section for insertion of the generally U-shaped cross section of the male joint element and the female joint element has two outwardly and laterally extending lips.

The above described folding baby bed can also include a fastener mechanism at each of the lower ends of the two support rods comprising a female and a male fastener elements. The fastener mechanisms can fasten to each other. The female fastener is made of a L-type steel plate installed at the middle of the front and back side of the bed frame respectively with two L-shaped openings arranged in opposite positions, the male fastener is made of a U-shaped plate installed at the lower end of each support post with a hinge respectively and the U-shaped plate has two round extensions extending leftwards and rightwards, respectively, for holding the L-shaped openings of the female fastener elements.

Further, the foldable baby bed advantageously includes a cushion fastener mechanism composed of a transverse tube which is part of the cushion and a fastening rod having a spiral spring at each end of the transverse tube. A nut at the inner end of each fastening rod pushes the spiral spring. The outer end of the fastening rod has a hook for mounting the mechanism to the bed frame by the tension of the spiral spring.

A further description of the invention is now given with reference to the drawings.

Figure 1:
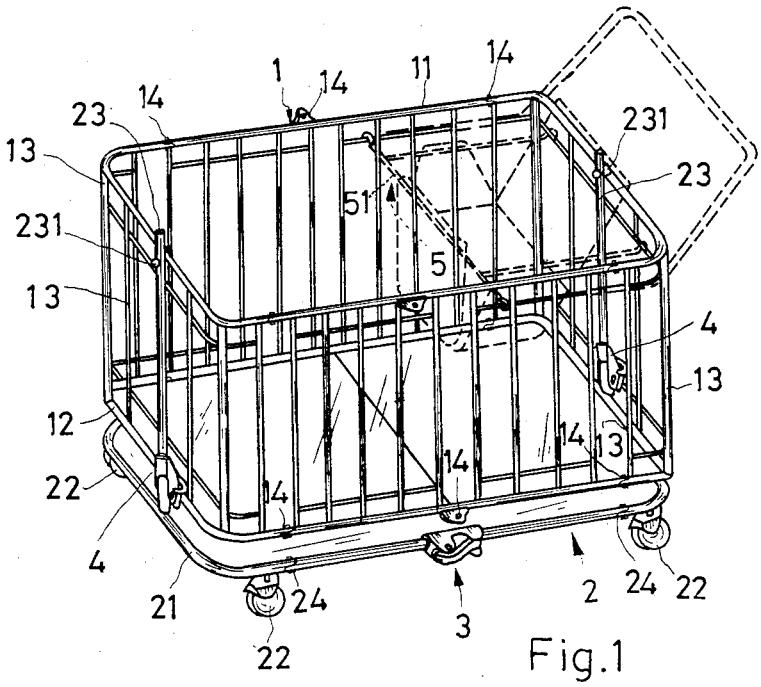
FIG. 1 is a perspective view of the present inventive foldable baby bed.

As shown in the FIG. 1, the foldable baby bed of the present invention mainly comprises a foldable bed frame (1) and a foldable base (2).

The bed frame (1) is composed of two boundary tubes (11) and (12) and a plurality of rods (13) supporting the boundary tubes around them. Each of the boundary tubes (11) and (12) has a hinged connection (14) at the middle of its left and right side tube and each end of the tube respectively so that each boundary tube is foldable in the horizontal direction to form a foldable bed frame. The base (2) is composed of a boundary tube (21), four castors (22) which are located at its four lower corners and two vertical rods (23) extending from the middle of its front and back tubes respectively. The boundary tube (21) has a hinge connection (24) at each end of its left and right side tubes which are foldable in the horizontal direction and it has an improved folding mechanism (3) at the middle of its left and right side tubes respectively for horizontal folding.

Figure 2:
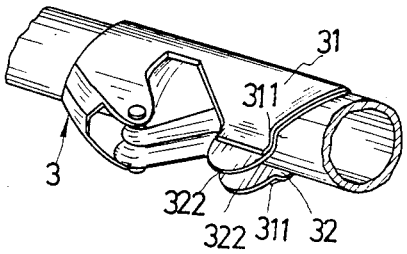
FIG. 2 is a perspective view of an improved folding mechanism according to the present invention.
Figure 3:
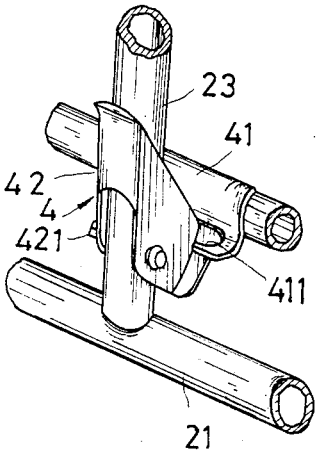
FIG. 3 is a perspective view of a bed frame fastener mechanism according to the present invention.
Figure 4:
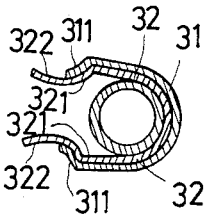
FIG. 4 is a perspective view of an improved folding mechanism according to the present invention.

The improved folding mechanism (3) comprises a pair of male (or outer) and female (or inner) joint element (31) which are hinged together and connectable with each other by insertion, as shown in FIG. 2. The female joint element (3) has a generally U-shaped cross section (311) and can be inserted into the male joint element (32) at its generally U-shaped cross section (321). The generally U-shaped cross section (321) of the male joint element (32) has two lips (322) extending laterally so that the generally U-shaped cross section (321) can be narrowed by pressing the lips manually in order to release the female joint element (31) to thereby permit folding about the joint for folding purposes. FIG. 2 thus shows the U-shaped make joint element (32) for fitting slidably over the pivot of a longitudinal member, or section of boundary tube (21), and U-shaped female joint element (31) for fitting slidably over the male joint element (31). The ends of the female joint element (31) are turned inwardly and the ends of the male joint element (32) are resilient and moveable towards one another from an uncompressed to the illustrated compressed position by application of external force means applied to tabs (322), the thereby permit disengagement of the female joint element (32) or engagement between the joint elements. The female and male joint elements are thus lockable during use but unlockable to permit folding.

The bed frame (1) is suspended on two hinges (231) at the upper ends of the left and right rods (23) respectively. The bed frame is thus swingable and pivotable about the hinges (231). A fastener mechanism (4) is respectively provided near the lower ends of the left and right rods (23) in order to fix the bed frame (1) when swinging is not required.

Figure 5:
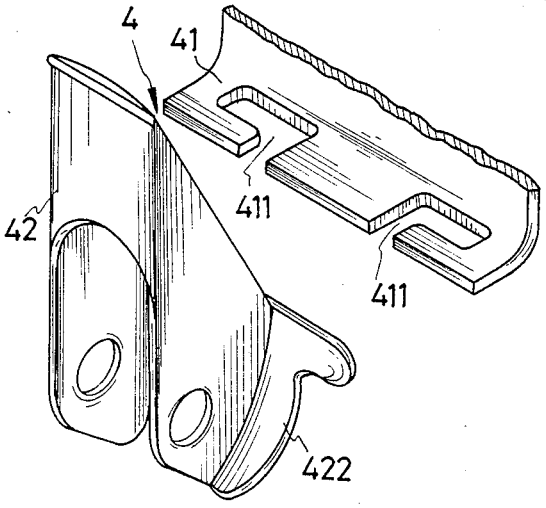
FIG. 5 is an exploded perspective view of a bed frame fastener mechanism according to the present invention.
Figure 6:
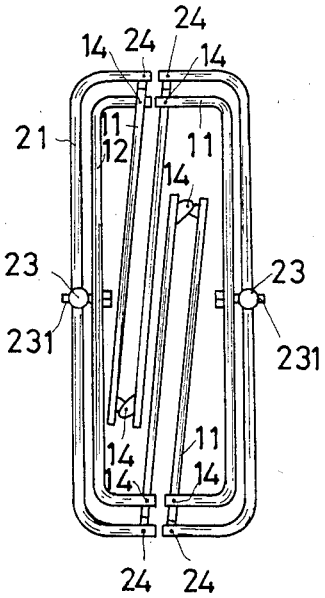
FIG. 6 is a perspective view of a foldable baby bed in a folded condition according to the present invention.

The fastener mechanism (4) comprises a pair of female and male fastening elements (41) and (42) which can fasten each other, as shown in FIG. 5. The female fastening element (41) is made of a L-shaped steel plate with its vertical portion welded to the middle of the front or rear short side of the bed frame and two opposing L-shaped openings (411) in its horizontal portion. The male fastening element (42) is made of a U-shaped plate located round the end rod (23) and hinged thereon by a hinge (421) near the lower end of the U-shaped plate. The U-shaped plate has two outwardly curved wing extentions (422) which respectively extend leftwrds or rightwards so that upon insertion and turning of the wings of the U-shaped plate (23) into the female fastening element (41) the wings are held in place in the L-shaped openings. The bed frame is thus held in a non-swinging mode.

Figure 7:
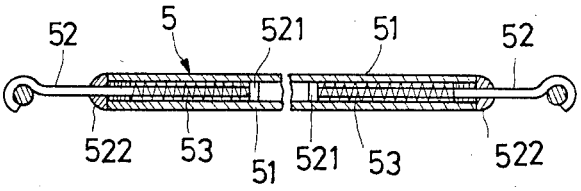
FIG. 7 is a longitudinal sectional view of a cushion fastener mechanism according to the present invention.

As shown in FIG. 7, the folding baby bed of the present invention includes an improved cushion mechanism (5). The cushion mechanism(s) is installed at the front side of the cushion and comprises a transverse tube (51) which is a part of the cushion, fastening rods (52) which extend outwardly from each end of the transverse tube (51), and a spiral spring (53). The fastening rod (52) has a nut (521) fixed in it for pushing a spiral spring (53) and it is screwed to the end of the transverse tube (51) by a hollow nut (522) screwed on the fastening rod (52). The hook portion of the fastening rod (52) extends outwardly of the transverse tube (51). Therefore, by pulling the fastening rod (52) outward, the hook of the fastening rod (52) can be hooked at the left side post or the right side post of the bed frame (2). The tension of a spring (53) the fastening rods (52) are firmly fixed to the bed frame.

I claim:

1. An improved foldable baby bed comprising:

a foldable bed frame and a foldable bed base wherein the bed frame is composed of an upper boundary tube and a lower boundary tube, said upper boundary tube having a front side, a back side, a left side and a right side, said lower boundary tube having a front side, a back side, a left side and a right side and a plurality of support posts between the upper and lower boundary tubes, said bed base is composed of a base boundary tube having a front side tube, a back side tube, a left side tube and a right side tube, said base boundary tube having four castors at its four lower corners, two support rods respectively extending upwardly from the middle of said left side of said base boundary tube and from said right side of said base boundary tube, said two support rods each having pivot means at the upper end of each said rod, said bed frame being coupled to each said support rod by said pivot means and being suspended whereby said bed frame is swingable with respect to said two support rods;

a hinged connection at the middle and at the end of each of said left and right side tubes of said upper boundary tube and of said lower boundary tube of said bed frame;

a folding mechanism at the end and at the middle of each of said left and right boundary tube of said base; and a pair of male and female joint elements which are hinged together and releasably lockable to each other, wherein each said male joint element has a U-shaped cross-sectional end and each said female joint element has a U-shaped cross-sectional end configured to receive U-shaped cross-sectional end of a said respective male joint element, said male joint element having two compressible tabs extending outwardly and laterally from the edges of a said female joint element when said female joint element and said male joint element are in a locked position.

2. A folding baby bed according to claim 1 wherein there is a fastener mechanism at each of the lower ends of the said two support rods, said fastener mechanism comprising interlockable female and male fastener elements, each said female fastener element is made of a L-shaped steel piece having a perpendicular portion and a substantially horizontal portion installed at the middle of each of said front and back sides of said lower boundary tube to said bed frame, said female fastener element having two L-shaped openings arranged in opposite positions in said horizontal portion, said male fastener element is made of a U-shaped member installed at the lower end of each said support rod, said male member being hingedly mounted to each said rod, said U-shaped members having two projections extending leftward and rightward therefrom for insertion into said pair of L-shaped openings in a respective said female fastener element.

3. A foldable baby bed according to claim 1, wherein said further baby bed includes a cushion fastener mechanism composed of a cushion transverse tube which is a part of said cushion, fastening rods, each said fastening rod having an interior end disposed within said cushion transverse tube and an outer end projecting outwardly from each end of the transverse tube, a sleeving element collaring each said fastening rod at the point each said rod starts extending outwardly from said transverse tube, a nut at the inner end of each fastening rod, and a spiral spring positioned between each said sleeving element and each said nut, the outer end of each said fastening rod having a hook to attach to the bed frame whereby the tension of each said spiral spring causes each said hook to be tightly attached to said bed frame.

* * * * *